US005681526A

United States Patent [19]

Zhang

[11] Patent Number: 5,681,526

[45] Date of Patent: Oct. 28, 1997

[54] METHOD AND APPARATUS FOR POST-COMBUSTION OF GASES DURING THE REFINING OF MOLTEN METAL

[75] Inventor: Xiaodong Zhang, Pittsburgh, Pa.

[73] Assignee: USX Corporation, Pittsburgh, Pa.

[21] Appl. No.: 636,329

[22] Filed: Apr. 23, 1996

[51] Int. Cl.[6] ..... C21B 7/16; C21C 5/32

[52] U.S. Cl. ..... 266/47; 266/225

[58] Field of Search ..... 266/225, 47; 239/398, 239/418, 433

[56] References Cited

U.S. PATENT DOCUMENTS

| | | | |
|---|---|---|---|
| 3,130,252 | 4/1964 | Metz | 239/418 |
| 3,216,714 | 11/1965 | Eibl et al. | 239/418 |
| 3,281,136 | 10/1966 | Metz | 266/225 |
| 3,350,084 | 10/1967 | Lucarell | 266/225 |
| 3,488,044 | 1/1970 | Shepherd | 266/225 |
| 4,304,549 | 12/1981 | Pfau | 239/433 |
| 4,366,953 | 1/1983 | Colling et al. | 266/225 |
| 4,396,182 | 8/1983 | Schaffar et al. | 266/225 |
| 4,434,005 | 2/1984 | Metz et al. | 266/47 |
| 4,533,124 | 8/1985 | Mercatoris | 266/225 |
| 4,740,242 | 4/1988 | Nakamura et al. | 266/225 |
| 4,746,103 | 5/1988 | Takashiba et al. | 266/225 |
| 4,971,297 | 11/1990 | Henrion et al. | 266/225 |
| 4,988,079 | 1/1991 | Takahashi et al. | 266/225 |
| 5,277,118 | 1/1994 | Bleser et al. | 266/225 |
| 5,302,112 | 4/1994 | Nabors, Jr. et al. | 239/418 |
| 5,332,199 | 7/1994 | Knapp et al. | 266/225 |
| 5,374,297 | 12/1994 | Schlichting | 266/225 |

FOREIGN PATENT DOCUMENTS

| | | |
|---|---|---|
| 151499 | 8/1985 | European Pat. Off. . |
| 4-259318 | 9/1992 | Japan . |
| 863-658 | 10/1979 | U.S.S.R. . |

*Primary Examiner*—Scott Kastler

*Attorney, Agent, or Firm*—Armstrong, Westerman, Hattori, McLeland & Naughton

[57] ABSTRACT

A post-combustion lance for use in refining molten metal and recovering heat by combustion of combustible gases evolved from the molten metal bath is provided with a plurality of pairs of post-combustion nozzles arranged about the periphery of the lance above the lower end thereof. The nozzles of each pair are directed downwardly toward the lower end of the lance and at an angle to a radius of the lance, such that supersonic oxygen jets emanating from corresponding nozzles of adjacent pairs intersect, whereby the momentum of the individual supersonic jets is partially cancelled thereby forming a single, subsonic oxygen jet which burns combustible off-gases above the surface of the molten metal bath, reducing heat loss by the anti-post-combustion reaction and minimizes furnace lining wear due to shorter flames.

15 Claims, 6 Drawing Sheets

METHOD AND APPARATUS FOR POST-COMBUSTION OF GASES DURING THE REFINING OF MOLTEN METAL

FIELD OF THE INVENTION

This invention relates to methods and means for converting a pair of supersonic oxygen or oxy/fuel jets to a subsonic jet, and more particularly to a method and apparatus for enhancing the recovery of heat by post-combustion of gases during the refining of molten metal, and especially to a method and apparatus for passing a pair of oxygen-containing gas streams at supersonic speed through first and second nozzles disposed at an angle to each other such that the jets intersect to produce a combined subsonic stream for post-combustion of gases above the molten metal.

DESCRIPTION OF THE PRIOR ART

Post-combustion of gases, mainly carbon monoxide, evolved from a molten metal bath, such as iron, during refining in a metallurgical vessel, such as a top-blown basic oxygen furnace (BOF) or a bottom blown furnace such as a Q-BOP, recovers heat energy by combustion of the evolved gases in accordance with the equation $$CO+1/2O_2=CO_2+\text{heat} \quad (1)$$

Reaction (1) is called the post-combustion reaction. However, a second reaction, the anti-post-combustion reaction also takes place in the metallurgical furnace, thus:

$$CO_2+[C]=2CO-\text{heat} \quad (2)$$

Under the conditions prevailing in a BOF or Q-BOP vessel, Reaction (1) is limited because of Reaction (2). That is, when CO, produced by reaction (1) contacts carbon in the molten metal, such as iron, at steelmaking temperature, $CO_2$ converts back to CO in accordance with Reaction (2). The overall result is that little or no net post-combustion reaction takes place.

Post-combustion in a BOP converter is effected by use of a dual-flow or post-combustion lance lowered vertically into the open mouth of the converter and having, in addition to a principal nozzle or nozzles at the lower end of the lance for projecting refining oxygen at supersonic speed onto and into the molten metal and overlying slag, a plurality of auxiliary or post-combustion nozzles spaced, e.g. several feet, above the lower end of the lance.

The efficiency of post-combustion in such a furnace is evaluated by means of the post-combustion ratio (PCR) and heat transfer efficiency (HTE). PCR is defined as the ratio of $CO_2$ to the sum of evolved $CO+CO_2$.

In order to increase the degree of post-combustion or the post-combustion ratio, PCR, sufficient distance is needed from the post-combustion region to the surface of the metal bath. This distance can be increased either by increasing the spacing between the main, refining nozzles and the auxiliary, post-combustion nozzles, or by delivering weak (soft or subsonic) oxygen jets from the post-combustion nozzles. Physically increasing the distance between the two sets of nozzles is limited by the vessel geometry and is subject to sacrifice of heat transfer efficiency to the bath. An example of such critical spacing is European patent document 151,499 which provides that the ratio of the diameter, ds, of the auxiliary nozzles to the axial distance, 1, between the primary, refining nozzles and the secondary, post-combustion nozzles is less than 0.02. Common prior art practice has been to utilize post-combustion nozzles designed to slow down the jet to subsonic velocity, as by use of divergent, slotted or tapered nozzles, or vanes or small diameter conduits, such as shown by U.S. Pat. No. 4,746,103, or with inner inlays or grooves, as in U.S. Pat. No. 4,366,953. Although such types of nozzle design can slow down the oxygen jets from supersonic to subsonic speed, usual attendant problems are nozzle plugging and lance barrel burning because the subsonic gas flow provides insufficient nozzle purging power, allowing deposits of metal and slag to form in and around the nozzles. A partially plugged nozzle is potentially harmful to furnace lining because of the uncertainty of oxygen jet direction. Removal and cleaning of plugged nozzles results in prolonged, expensive furnace downtime.

SUMMARY OF THE INVENTION

The present invention avoids the mentioned problems with prior art post-combustion lances by providing a method and means for passing first and second streams of oxygen-containing gas through respective first and second post-combustion nozzles at supersonic speed, for example, above and toward the surface of molten metal contained in a refining vessel, and with the nozzles disposed at an angle to each other so that the emergent supersonic gas streams intersect, with the result that the momentum of the respective jets is partially cancelled and a subsonic jet is produced. The resulting subsonic jet is a short, planar jet, and very easy to decay, so that, in the case of a refining vessel, the post-combustion takes place at a location above and spaced from the metal bath so as to minimize reaction (2) the anti-post-combustion reaction and to maximize reaction (1) the post-combustion reaction, thus increasing PCR and HTE.

DESCRIPTION OF PREFERRED EMBODIMENTS

Figure 1:
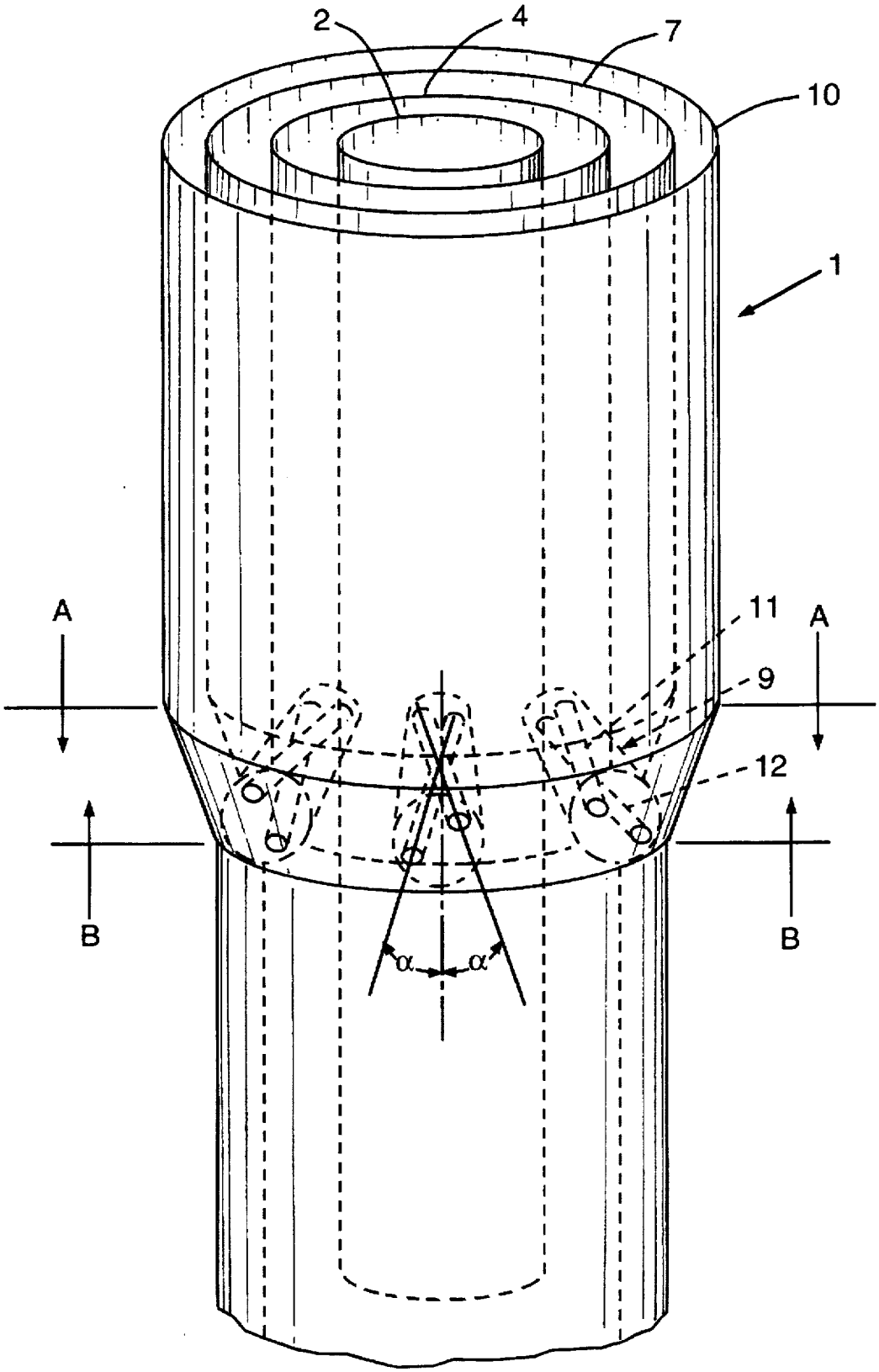
FIG. 1 is a side elevation of a portion of a refining lance, showing auxiliary, post-combustion nozzles in accordance with the invention.
Figure 2:
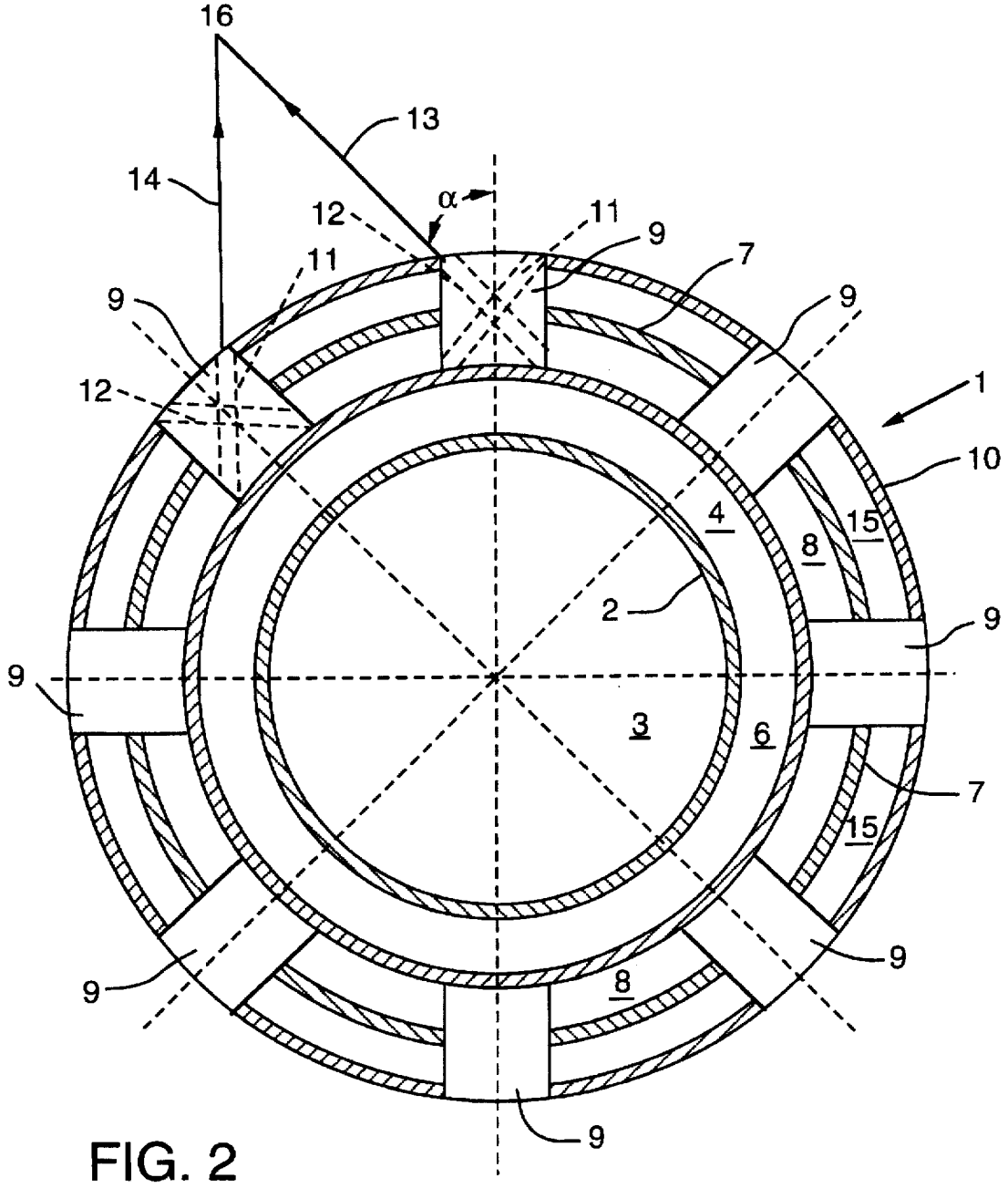
FIG. 2 is a top plan view taken along lines A—A and B—B of FIG. 1.

FIGS. 1 and 2, relating to a preferred embodiment of the invention, shows a refining lance denoted generally by the numeral 1 adapted to be inserted vertically into the open mouth of a basic oxygen furnace (BOF). As more clearly shown in FIG. 2, lance 1 comprises a first wall 2 defining a primary oxygen passage 3 leading to a primary, refining nozzle (not shown) of usual type located at the lower end of the lance 1; a second wall 4 which, with wall 2, defines an annular space 6 for passage of secondary or post-combustion oxygen, and a third wall 7 and fourth wall 10. The third wall 7, with the second wall 4, defines an annular space 8 for entry and circulation of cooling water. Fourth wall 10, with third wall 7, defines an annular space 15 for circulation and exit of cooling water. Mounted in spaces 8 and 15, and spaced apart around the periphery of the lance 1, are a plurality of nozzle blocks 9. Eight such blocks are shown in FIG. 2. Each of the blocks 9 is drilled to provide a pair of nozzle passageways and orifices 11 and 12 in communication with the secondary oxygen passage 6 and disposed downwardly in the direction of a molten metal bath contained in the BOF into which lance 1 may be lowered. Orifices 11 and 12 also are disposed at an angle to each other, so that supersonic oxygen jets emanating from corresponding orifices of adjacent pairs, as shown by lines 13 and 14 in FIG. 2, and intersecting, as at point 16 of FIG. 2, form a single subsonic jet. This angle is determined by the angle, alpha, between each orifice passageway and a radius of lance 1, as shown in FIGS. 1 and 2, and which latter angle is from 30° to 63°, preferably 48° to 63°. Representative oxygen flow rate is from about 500 scfm to 2500 scfm, and as high as 4000 scfm, with ⅛ inch diameter circular nozzle orifices arranged at such angle.

Figure 3:
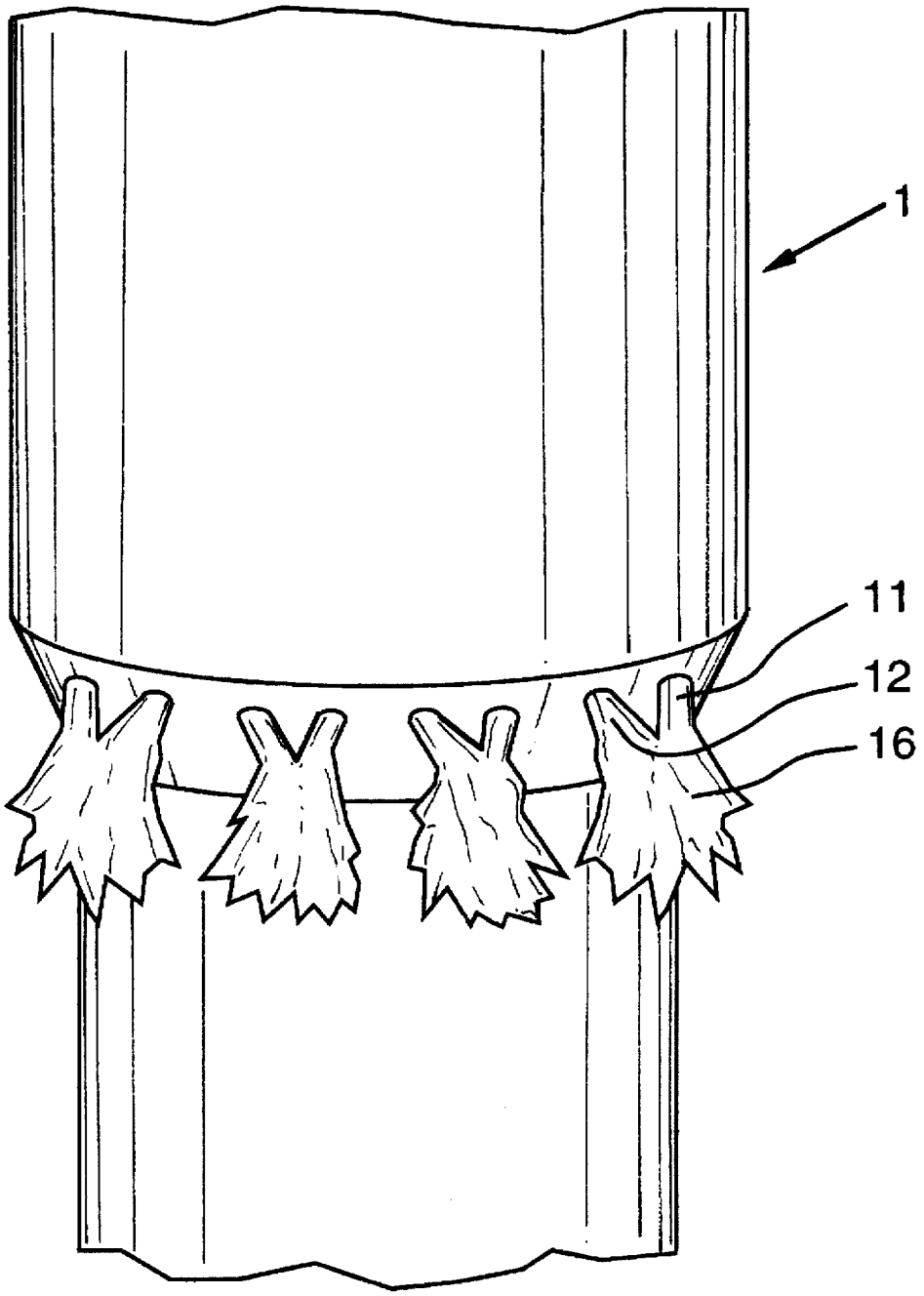
FIG. 3 is a side elevation of a portion of a refining lance, showing the post-combustion nozzles in operation and the resulting subsonic jet.
Figure 4:
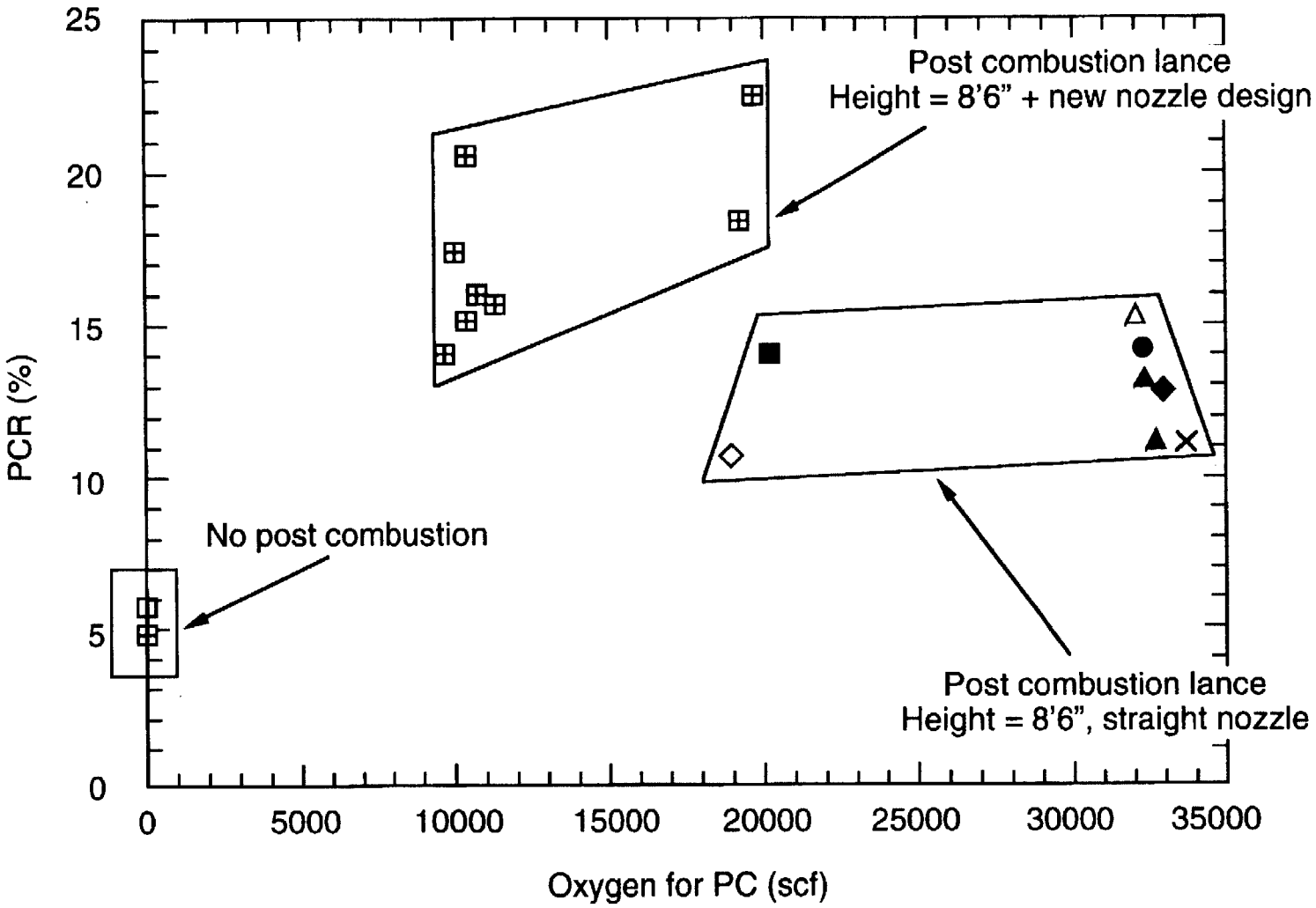
FIG. 4 is a graph relating % $PCR_{mean}$ and post-combustion oxygen flow for a prior art refining lance and a lance in accordance with the present invention.
Figure 5:
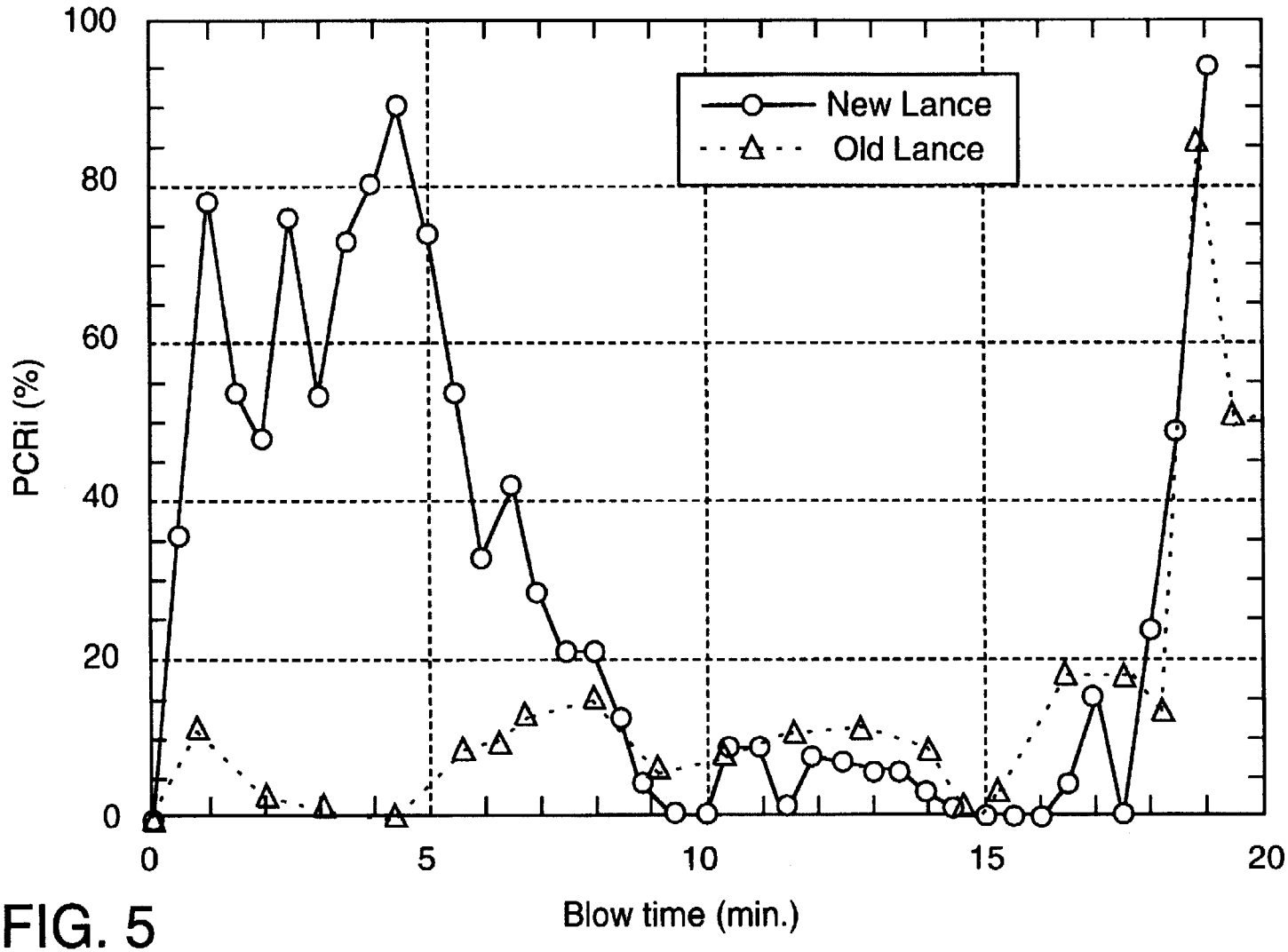
FIG. 5 is a graph relating % $PCR_{instantaneous}$ and oxygen blowing time for a prior art refining lance and a lance in accordance with this invention.

The resulting combined oxygen jets are short, fat, planar jets which readily decay, as shown in FIG. 3, so do not tend to extend to the metal/slag layer such that $CO_2$ would combine with carbon in the molten metal to form carbon monoxide in accordance with the anti-post-combustion reaction (2). Thereby the post-combustion ratio and heat transfer efficiency are increased while plugging of the post-combustion nozzles with splashed molten metal and/or slag is effectively prevented or minimized. Such effect on post-combustion ratio is illustrated by the graph of FIG. 4, in which the several points on the graph represent different heats made with a conventional post-combustion lance having straight post-combustion nozzles and with the new lance of this invention having the angled nozzles as above described. From that FIG. it will be seen that much higher mean PCR values are achieved with the new lance than with the conventional one, at practically all rates of oxygen flow. Similarly, FIG. 5 shows that the new lance design provides much higher instantaneous PCR values, especially in the first 8–10 minutes of blowing time.

Figure 6:
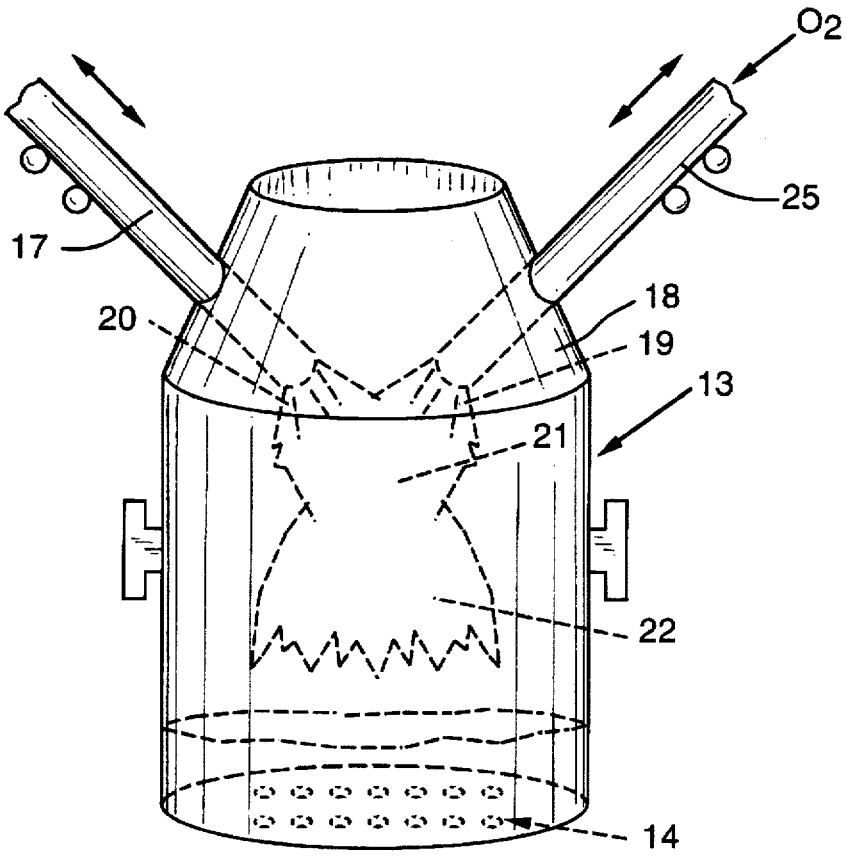
FIG. 6 is a side elevation of a Q-BOP converter fitted with post-combustion nozzles in accordance with this invention.

The principles of the invention also may be applied to post-combustion of $CO_2$ in a bottom-blown steelmaking furnace, such as the Q-BOP, as shown in FIG. 6 wherein the furnace is generally denoted by the numeral 13 and is provided with bottom tuyeres 14. Lances 17 and 25 extend through a conical section 18 of the furnace body to a point approaching the vertical centerline of the furnace and supersonic oxygen jets 19 and 20 intersect at point 21 to form a combined subsonic jet 22 for post-combustion of $CO_2$ without substantial occurrence of the undesirable anti-post-combustion reaction (2).

Figure 7:
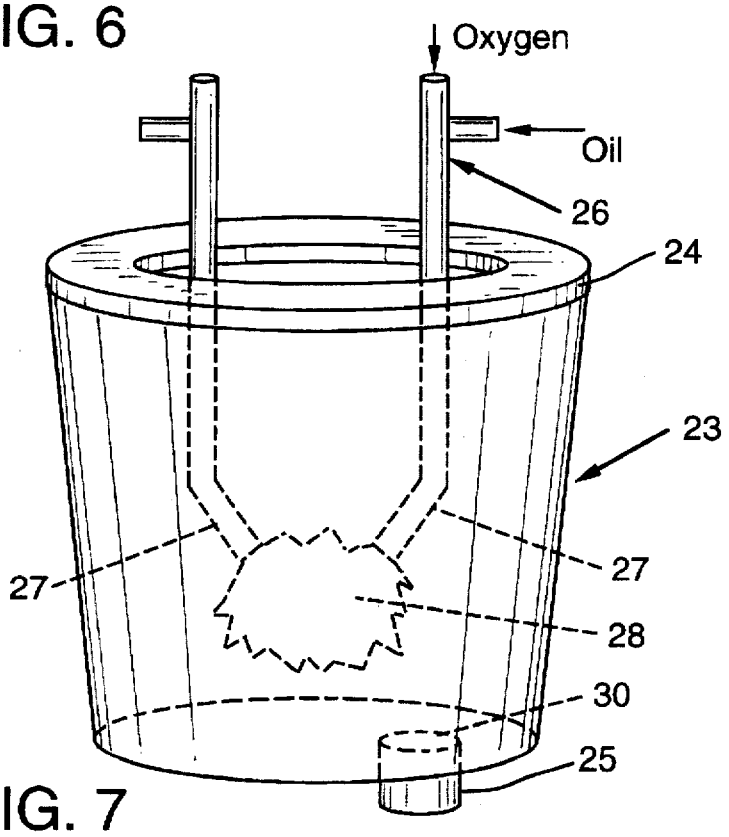
FIG. 7 is a side elevation of a metallurgical ladle fitted with preheating lances having nozzles in accordance with this invention.

A further embodiment of the invention is shown in FIG. 7, in which a metallurgical ladle 23, having a cover 24, and pouring tube 25 filled with sand 30, is preheated by means of a pair of lances 26 having nozzles 27 adapted to provide intersecting high speed jets of oxygen and fuel oil to produce a lower speed combined flame 28 to preheat the vessel.

What is claimed is:

1. A method of post-combusting carbon monoxide evolved from a molten bath in a metallurgical vessel fitted with an elongated, substantially vertical oxygen lance wherein a primary jet of refining oxygen is ejected from a first nozzle at a lower end of the lance onto the molten bath, comprising providing at least one pair of lance auxiliary nozzles arranged above the first nozzle at an angle to each other and adapted to eject a corresponding pair of supersonic oxygen jets, intersecting the supersonic jets to partially cancel the momentum of the individual supersonic jets and to combine them into a single subsonic jet spaced above the lower end of the lance, and with said single subsonic jet combusting above the molten bath carbon monoxide evolved from the molten bath.

2. A method according to claim 1, further comprising spacing apart a plurality of pairs of auxiliary nozzles about the periphery of the lance at a distance from the lower end of the lance and such that the auxiliary nozzles point downwardly toward the lower end of the lance and in opposite directions, and at an angle between each auxiliary nozzle and a radius of the lance is from about 30° to about 63°.

3. A method according to claim 2, wherein the angle is from about 48° to about 63°.

4. A method for enhancing the recovery of heat by post-combustion of combustible gas evolved from a molten metal bath during refining of the molten metal bath, comprising:

a. passing a first stream of oxygen-containing gas at supersonic speed through a first orifice disposed above the surface of the molten metal bath and directed downwardly toward the surface of the molten metal bath;

b. passing a second stream of oxygen-containing gas at supersonic speed through a second orifice disposed above the surface of the molten metal bath and directed downwardly toward the surface of the molten metal bath, and c. intersecting the first and second streams of gas at a point equidistant from the first and second orifices and above the surface of the molten metal bath and at an angle such that the momentum of the first and second streams of gas is partially cancelled thereby producing a single, combined stream of gas of subsonic speed which burns the combustible gas above the surface of the molten metal bath and reduces heat loss by the anti-post-combustion reaction.

5. A method according to claim 4, further comprising spacing a plurality of pairs of orifices about the periphery of a refining and post-combustion lance adapted for vertical insertion into a mouth of a basic oxygen furnace and above a lower end of the lance and such that the orifices are arranged in opposite directions at an angle between each orifice and a radius of the lance, whereby supersonic gas streams emanating from corresponding orifices of adjacent orifice pairs intersect at a point above the surface of the molten metal to form a single subsonic gas stream for combusting evolved gas above the surface of the molten metal bath.

6. A method according to claim 5, wherein the angle is from about 30° to about 63°.

7. A method according to claim 5, wherein the angle is from about 48° to about 63°.

8. A post-combustion lance for use in a top-blown basic oxygen furnace in which molten iron is to be refined, comprising an elongated metal body having at least one longitudinal passage for receiving oxygen-containing gas at an upper end of the body, and at least one pair of post-combustion orifices spaced above a lower end of the body and in fluid communication with said at least one passage, said orifices having central axes extending downwardly toward the lower end of said body and in separate directions at an angle at which gas streams emanating from the orifices intersect at a point remote from said body and above the lower end thereof.

9. A lance according to claim 8, further comprising a plurality of orifice pairs spaced around an outer periphery of said metal body, and wherein the point of intersection of said gas streams is equidistant from the respective orifices in each pair.

10. A lance according to claim 9, wherein the angle is between the orifice and a radius of the metal body and is from about 30° to about 63°.

11. A lance according to claim 10, wherein the angle is from about 48° to about 63°.

12. A post-combustion lance for use in a top-blown basic oxygen furnace in which molten iron is to be refined, said lance comprising:

a. an elongated metal body comprising a first, central passage extending along the length of the body for receiving oxygen and delivering oxygen to at least one primary refining nozzle at a lower end of the body;

b. a second, annular passage surrounding at least an upper portion of said first passage for receiving oxygen and delivering oxygen to a plurality of secondary, post-combustion nozzles;

c. concentrically spaced apart third and fourth annular passages surrounding the first and second passages for, respectively, receiving and discharging a circulating supply of water for cooling the lance body;

d. a plurality of secondary, post-combustion nozzle blocks mounted in the third and fourth annular passages and spaced apart about the periphery of said body above the lower end thereof, and e. a pair of fifth passages in each nozzle block wherein each such passage is directed downwardly toward the lower end of said body and at an angle with respect to a radius of said body and is in communication with said second passage and terminating in an orifice for exit of a supersonic jet of oxygen-containing gas such that the supersonic gas jets from corresponding orifices in adjacent nozzle blocks intersect at a point remote and equidistant from the respective corresponding orifices of adjacent nozzle blocks and combine to form a single, subsonic gas jet.

13. A lance according to claim 12, wherein the angle is from about 30° to about 63°.

14. A lance according to claim 12, wherein the angle is from about 48° to about 63°.

15. Apparatus for post-combusting carbon monoxide evolved from a molten bath in a metallurgical vessel fitted with an elongated, substantially vertical oxygen lance having a first nozzle at a lower end of the lance adapted to eject a jet of refining oxygen onto the molten bath, comprising at least one pair of auxiliary nozzles arranged above the first nozzle at an angle to each other and adapted to eject a corresponding pair of supersonic oxygen jets intersecting each other and combining into a single subsonic jet spaced above the lower end of the lance and to combust above the molten bath carbon monoxide evolved from the molten bath.

* * * * *